US011215347B2

(12) United States Patent
Xie et al.

(10) Patent No.: US 11,215,347 B2
(45) Date of Patent: Jan. 4, 2022

(54) LIGHTING APPARATUS

(71) Applicant: XIAMEN LEEDARSON LIGHTING CO., LTD, Fujian (CN)

(72) Inventors: Shijian Xie, Fujian (CN); Zhengkun Liu, Fujian (CN); Dingwei Liang, Fujian (CN); Wenpei Li, Fujian (CN); Shaowei Huang, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/105,648

(22) Filed: Nov. 27, 2020

(65) Prior Publication Data

US 2021/0156552 A1 May 27, 2021

(30) Foreign Application Priority Data

Nov. 27, 2019 (CN) ..... 201922083201.3

(51) Int. Cl.

| | |
|---|---|
| ***F21V 23/00*** | (2015.01) |
| ***F21V 5/00*** | (2018.01) |
| ***F21V 23/06*** | (2006.01) |
| *F21V 29/70* | (2015.01) |
| *F21Y 115/10* | (2016.01) |

(52) U.S. Cl.

CPC ..... *F21V 23/004* (2013.01); *F21V 5/007* (2013.01); *F21V 23/06* (2013.01); *F21V 29/70* (2015.01); *F21Y 2115/10* (2016.08)

(58) Field of Classification Search

CPC ..... F21V 23/004; F21V 5/007; F21V 23/06; F21V 29/70; F21V 23/009; F21Y 2115/10; F21Y 2103/33; F21Y 2105/18; F21L 4/00; F21K 9/00

See application file for complete search history.

(56) References Cited

U.S. PATENT DOCUMENTS

| | | | | |
|---|---|---|---|---|
| 9,285,109 | B1 * | 3/2016 | Olsson | F21V 29/70 |
| 10,352,550 | B1 * | 7/2019 | Olsson | F21V 29/70 |
| 2008/0084693 | A1 * | 4/2008 | Shimada | F21V 5/003 362/240 |
| 2010/0060130 | A1 * | 3/2010 | Li | F21V 29/83 313/46 |
| 2015/0309389 | A1 * | 10/2015 | Pohlert | H04N 5/2354 362/11 |
| 2016/0116146 | A1 * | 4/2016 | Van Winkle | F21V 23/06 362/311.02 |
| 2016/0298824 | A1 * | 10/2016 | Holland | H05B 45/00 |
| 2017/0198447 | A1 * | 7/2017 | Tanoury | E01F 9/623 |

* cited by examiner

*Primary Examiner* — Britt D Hanley

*Assistant Examiner* — Glenn D Zimmerman

(74) *Attorney, Agent, or Firm* — Chun-Ming Shih; Lanway IPR Services

(57) ABSTRACT

A lighting apparatus includes a driver, a bottom cover, a light source module, a lens module, a light passing cover and a base plate. The bottom cover has a first central opening a driver container for storing the driver. The light source module has multiple LED modules and a second central opening. The lens module has a third central opening and multiple diffusion lenses respectively placed above the multiple LED modules. The lens module is fixed to the bottom cover to make the light source module, the driver, the lens module and the bottom cover as a portable module. The first central opening, the second central opening and the third central opening together form a main central opening. The base plate may be fixed to an installation platform.

19 Claims, 8 Drawing Sheets

LIGHTING APPARATUS

FIELD

The present invention is related to a lighting apparatus, and more particularly related to a lighting apparatus with thin design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People look for light devices that have low cost while providing flexible and thin design so as to be attached to various environments.

It is difficult to balance different factors to find out a good solution.

In addition, it is beneficial if the components can be replaced easily so as to satisfy different needs. Assembly cost is also important.

SUMMARY

In some embodiments, a lighting apparatus includes a driver, a bottom cover, a light source module, a lens module, a light passing cover and a base plate.

The bottom cover has a first central opening and a driver container for storing the driver.

The light source module has multiple LED modules and a second central opening.

The lens module has a third central opening and multiple diffusion lenses respectively placed above the multiple LED modules.

The lens module is fixed to the bottom cover to make the light source module, the driver, the lens module and the bottom cover as a portable module.

The first central opening, the second central opening and the third central opening together form a main central opening.

The base plate may be fixed to an installation platform.

The bottom cover is fixed to the base plate.

The base plate has multiple connectors for detachably connecting the light passing cover.

In some embodiments, the lighting apparatus may also include a heat dissipation plate.

The heat dissipation plate is placed between the driver and the light source module.

The heat dissipation plate has a fourth central opening.

The fourth central opening is corresponding to the main central opening.

In some embodiments, the lens module is a transparent plastic plate.

The multiple diffusion lenses are formed directly on the transparent plastic plate.

In some embodiments, the lens module has a buckle structure to fix to the bottom cover for concealing the driver and the light source module.

In some embodiments, at least some of the LED modules have two types of LED chips.

In some embodiments, the light source module has multiple light source sectors.

In some embodiments, the multiple light sources have buckle units for connecting the multiple light source sectors.

In some embodiments, there is a heat dissipation plate disposed below the multiple light source sectors.

In some embodiments, the multiple light source sectors are buckled to electrical plugs on the heat dissipation plate to be electrically connected to the drive module.

In some embodiments, the driver has a first driver connector to attach to a second driver connector disposed on the bottom cover to fix driver to the bottom cover.

In some embodiments, the bottom cover has a conductive path for electrically connecting the driver to the light source module.

In some embodiments, the conductive path has a terminal for electrically connected to an external power wire for receiving an external power provided to the driver.

In some embodiments, the multiple connectors include a buckle plate and two rotation buckle pins.

In some embodiments, the bottom cover has an inner wall defining the first central opening.

The base plate has at least a central protruding unit for aligning the inner wall of the bottom cover.

In some embodiments, there are multiple central protruding units.

Each central protruding unit has an elastic hook for deforming when inserting the bottom cover to the base plate and for holding the bottom cover to the base plate with elastic force of the multiple central protruding units.

In some embodiments, there is a U-shape support bracket disposed on the base plate.

Two arms of the U-shape support bracket engage the inner wall of the bottom cover.

In some embodiments, a battery is detachably disposed in a container space between the bottom cover and the light source module.

In some embodiments, there are tilt angles for placing the LED modules respect to the light passing cover for directing lights of the LED modules evenly on the light passing cover.

In some embodiments, a smart control module is electrically connected to the driver and is placed in the main central opening.

In some embodiments, the smart control module is detachable connected to a extending terminal disposed on an inner wall of the bottom cover.

DETAILED DESCRIPTION

Figure 6:
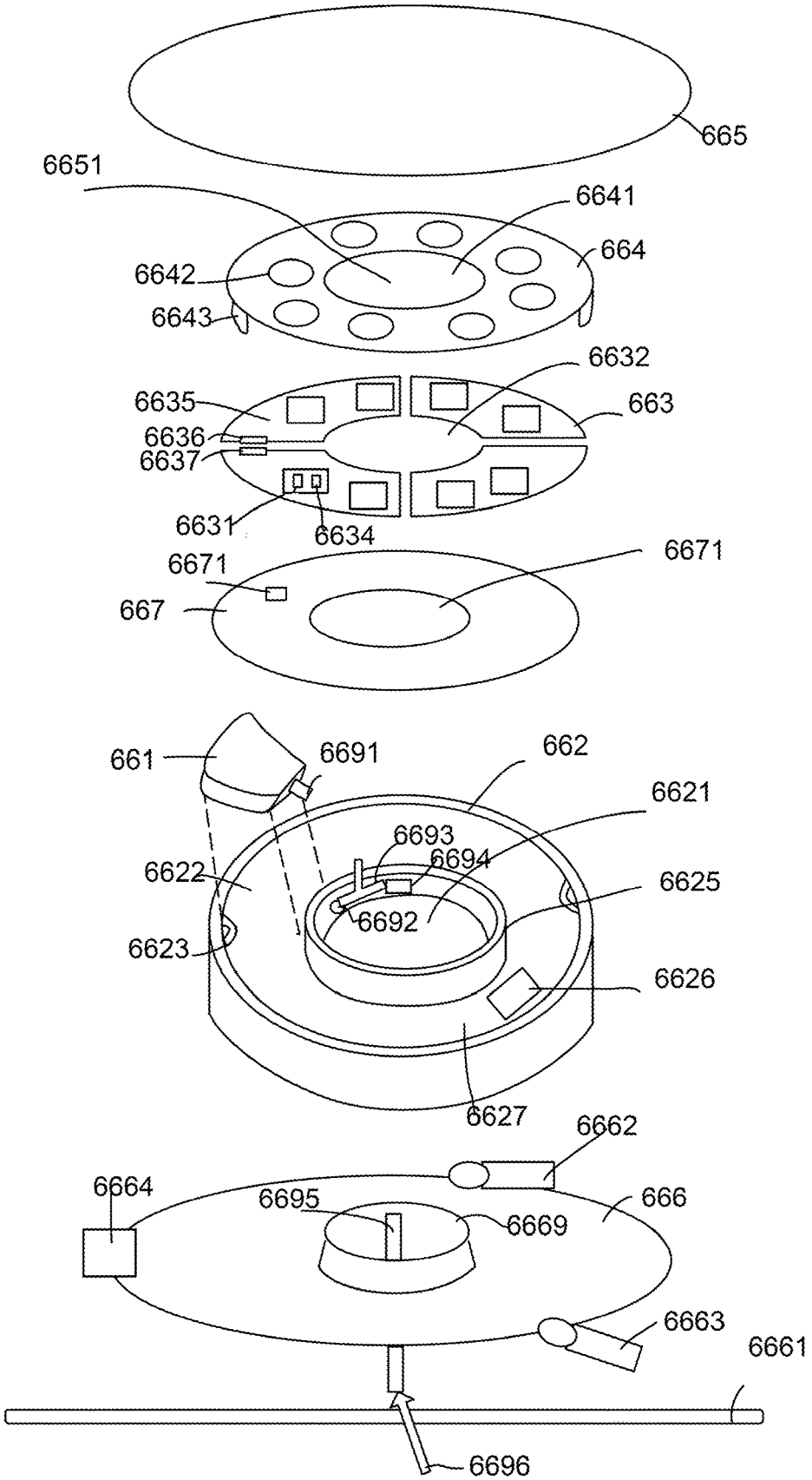
FIG. 6 illustrates another embodiment.

In FIG. 6, a lighting apparatus includes a driver 661, a bottom cover 662, a light source module 663, a lens module 664, a light passing cover 665 and a base plate 666.

The bottom cover 662 has a first central opening 6621 and a driver container 6622 for storing the driver 661. The bottom cover 662 may be made of plastic, metal or mixed material.

The light source module 663 has multiple LED modules 6631 and a second central opening 6632.

The lens module 664 has a third central opening 6641 and multiple diffusion lenses 6642 respectively placed above the multiple LED modules 6631.

The lens module 6642 is fixed to the bottom cover 662 to make the light source module 663, the driver 661, the lens module 664 and the bottom cover 662 as a portable module.

The first central opening 6621, the second central opening 6632 and the third central opening 6641 together form a main central opening 6651. Specifically, the main central opening 6651 is an intersection area of the first central opening 6621, the second central opening 6632 and the third central opening 6641.

The base plate 666 may be fixed to an installation platform 6661, e.g. a downlight cavity, a ceiling, a bracket or other places to fix the lighting apparatus. The base plate 666 is fixed to the installation platform with screws, buckle or other fixing devices. In some embodiments, the base plate 666

The bottom cover 662 is fixed to the base plate 666.

The base plate 666 has multiple connectors 6662, 6663, 664 for detachably connecting the light passing cover 665.

In the example of FIG. 6, the lighting apparatus also has a heat dissipation plate 667.

The heat dissipation plate 667 is placed between the driver 661 and the light source module 663. In such arrangement, the heat dissipation plate covers the driver 663 so that if there is a protruding object like a capacitor in the driver, such protruding object does not produce shadow on output light pattern.

The heat dissipation plate 667 may be made of metal, plastic material with high heat dissipation ratio or a metal wrapped with plastic material.

The heat dissipation plate 667 has a fourth central opening 667.

The fourth central opening 667 is corresponding to the main central opening 6651. In some embodiments, the main central opening 6651 is a circular shape. Like the main central opening 6651, the first central opening 6621, the second central opening 6632 and the third central opening 6641 may be kept circular shapes. These central openings together define a common opening, e.g. the main central opening, so as to provide a space for wiring or for installing another component.

In some embodiments, the lens module is a transparent plastic plate.

Figure 7:
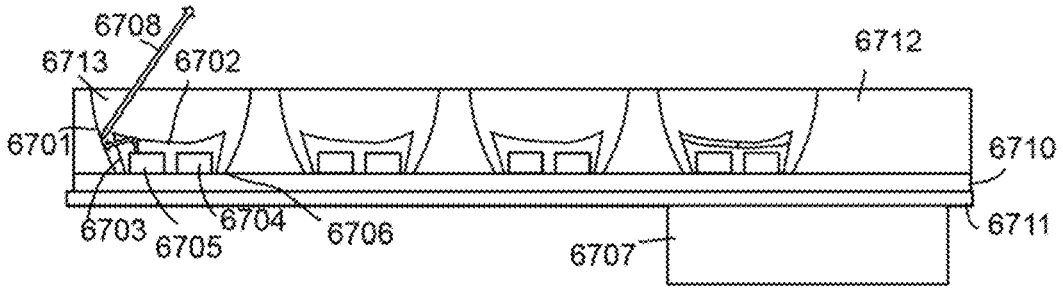
FIG. 7 illustrates a lens module covering multiple LED modules respectively with different lenses.

Please refer to FIG. 7, which illustrates a relation among several key components of the embodiment.

In FIG. 7, a transparent plastic plate 6712 has multiple lens modules 6713. Each lens module 6713 has a first reflective surface 6702 facing the LED chips 6704, 6705 of a LED module on a light source plate 6710 as a light source module. The light source module is placed on a heat dissipation plate 6711. A driver 6707 is placed below the light source module and the heat dissipation plate 6711. The LED chips 6704, 6705 may be different types of LED chips with different optical parameters, e.g. covered with different fluorescent layers or with different semiconductor arrangements.

The first reflective surface 6702 reflects the light 6708 emitted from the LED chips 6704, 6705 to a refraction surface 6703 that is disposed on lateral wall of the lens module 6713 that has a bottom side 6706 standing on the light source plate 6710. The light 6708 continues to be reflected by a second reflective layer 6701 on an exterior lateral surface of the lens module 6713. The second reflective layer 6701 further reflects the light 6708 to an escape opening of the lens module for diffusing the light of the LED chips 6704, 6705. The driver 6707 is electrically connected to the LED modules 6713 to provide driving currents and to control the LED modules 6713 to act as required parameters, e.g. color temperatures, colors and/or other optical parameters.

The multiple diffusion lenses are formed directly on the transparent plastic plate, e.g. via a plastic molding procedure.

In FIG. 6, the lens module 664 has a buckle structure 6643 to fix to a corresponding fixing unit 6623 of the bottom cover for concealing the driver 661 and the light source module 663.

In some embodiments, at least some of the LED modules have two types of LED chips, like the example shown in FIG. 7.

In some embodiments, the light source module has multiple light source sectors. FIG. 6 shows the light source module 663 has four light source sectors 6635.

In some embodiments, the multiple light sources have buckle units 6636, 6637 for connecting the multiple light source sectors 6635.

In some embodiments, there is a heat dissipation plate 667 disposed below the multiple light source sectors 6635.

In some embodiments, the multiple light source sectors 6635 are buckled to electrical plugs 6671 on the heat dissipation plate 667 to be electrically connected to the drive module. Specifically, there is a conductive path or a through hole for routing the electricity of the driver to the LED modules on the light source sectors 6635.

In some embodiments, the driver 661 has a first driver connector 6691 to attach to a second driver connector 6692 disposed on the bottom cover 662 to fix the driver 661 to the bottom cover 662.

In some embodiments, the bottom cover 662 has a conductive path 6693 for electrically connecting the driver 661 to the light source module 663. For example, the conductive path 6693 may include wires or metal path covered or non-covered by insulation material for routing the electricity to the LED modules mentioned above.

In some embodiments, the conductive path has a terminal 6694 for electrically connected to an external power wire 6695 for receiving an external power 6696 provided to the driver 661.

In some embodiments, the multiple connectors include a buckle plate 664 and two rotation buckle pins 6662. The rotation pins 6662 may be rotated with to change a holding diameter for inserting the light passing cover and then be rotated to hold the light passing cover.

Figure 2:
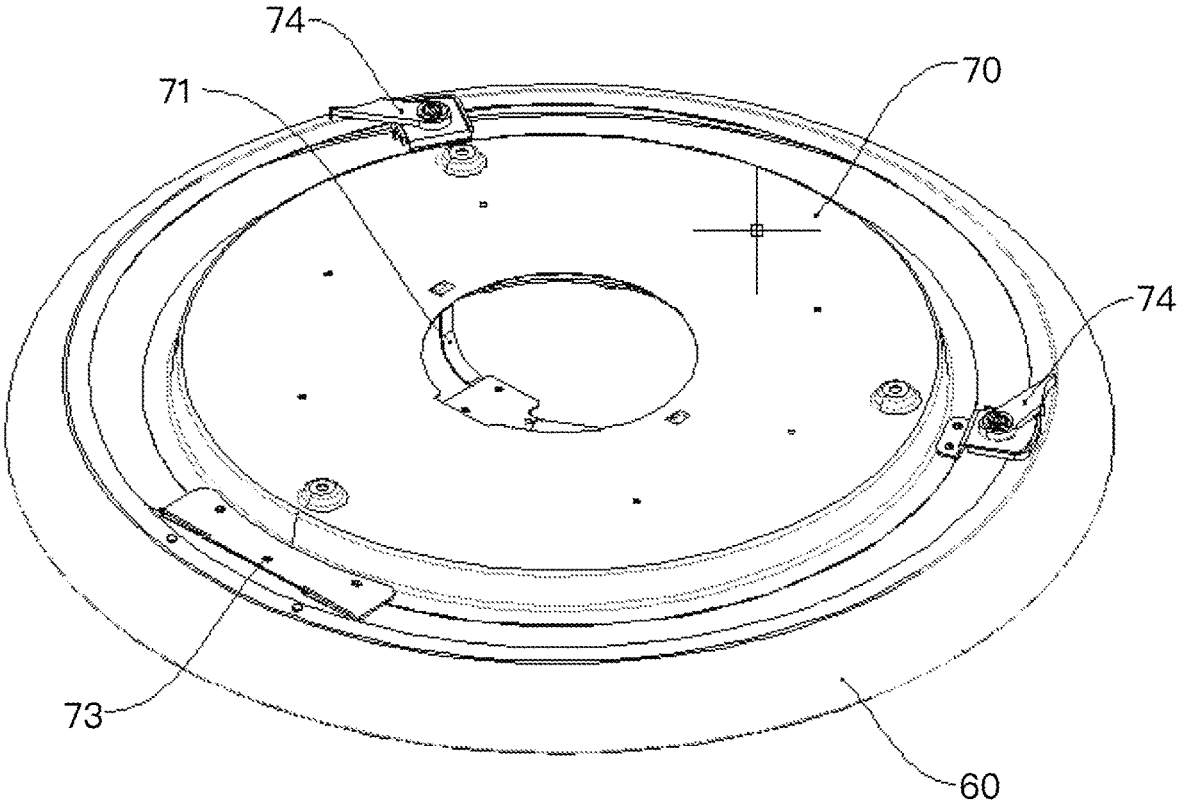
FIG. 2 illustrates a back view of the example in FIG. 1.

The example of FIG. 2 shows a more detailed structures for persons of ordinary skilled in the art to implement an embodiment, but the structures are not limited to the examples provided.

In some embodiments, the bottom cover 662 has an inner wall 6625 defining the first central opening 6621.

The base plate 666 has at least a central protruding unit 6669 for aligning and connecting the inner wall 6625 of the bottom cover 662.

In some embodiments, there are multiple central protruding units. For example, the central protruding unit 6669 may include multiple reverse hooks to capture and fix the inner wall 6625 of the bottom cover 662.

Figure 8A:
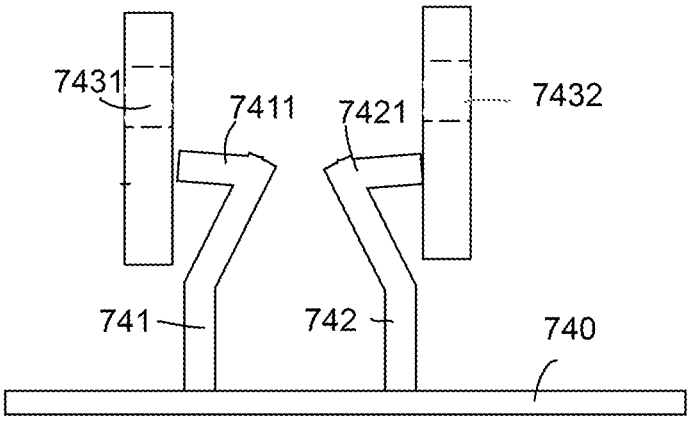
FIG. 8A and FIG. 8B illustrate a connection between the base plate and the bottom cover.
Figure 8B:
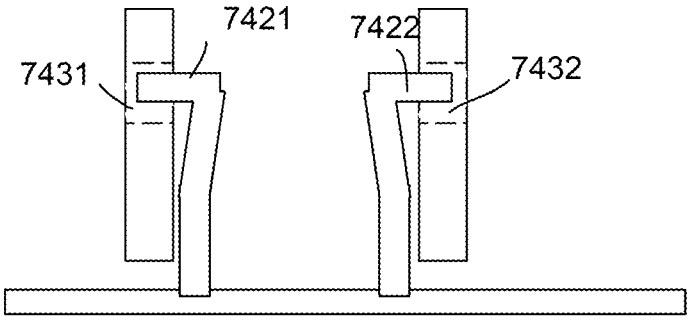

FIG. 8A and FIG. 8B show an example of such design. Each central protruding unit 741, 742 of the base plate 740 has an elastic hook 7411, 7421 for deforming when inserting a corresponding groove 7431, 7432 of the bottom cover to the base plate 740 and for holding the bottom cover to the base plate 740 with elastic force of the multiple central protruding units 741, 742.

Figure 3:
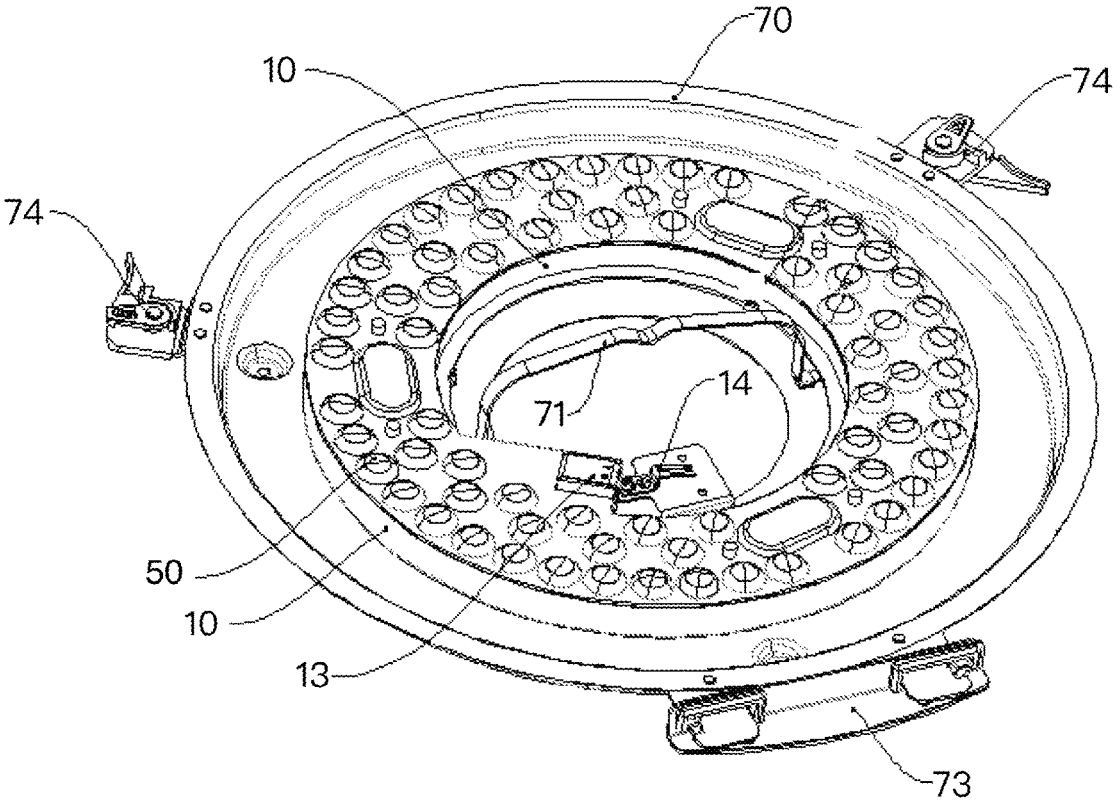
FIG. 3 illustrates a top view of the embodiment of FIG. 1 without a light passing cover.

In some embodiments, there is a U-shape support bracket disposed on the base plate, e.g. the U-shape support 71 in FIG. 3.

Figure 1:
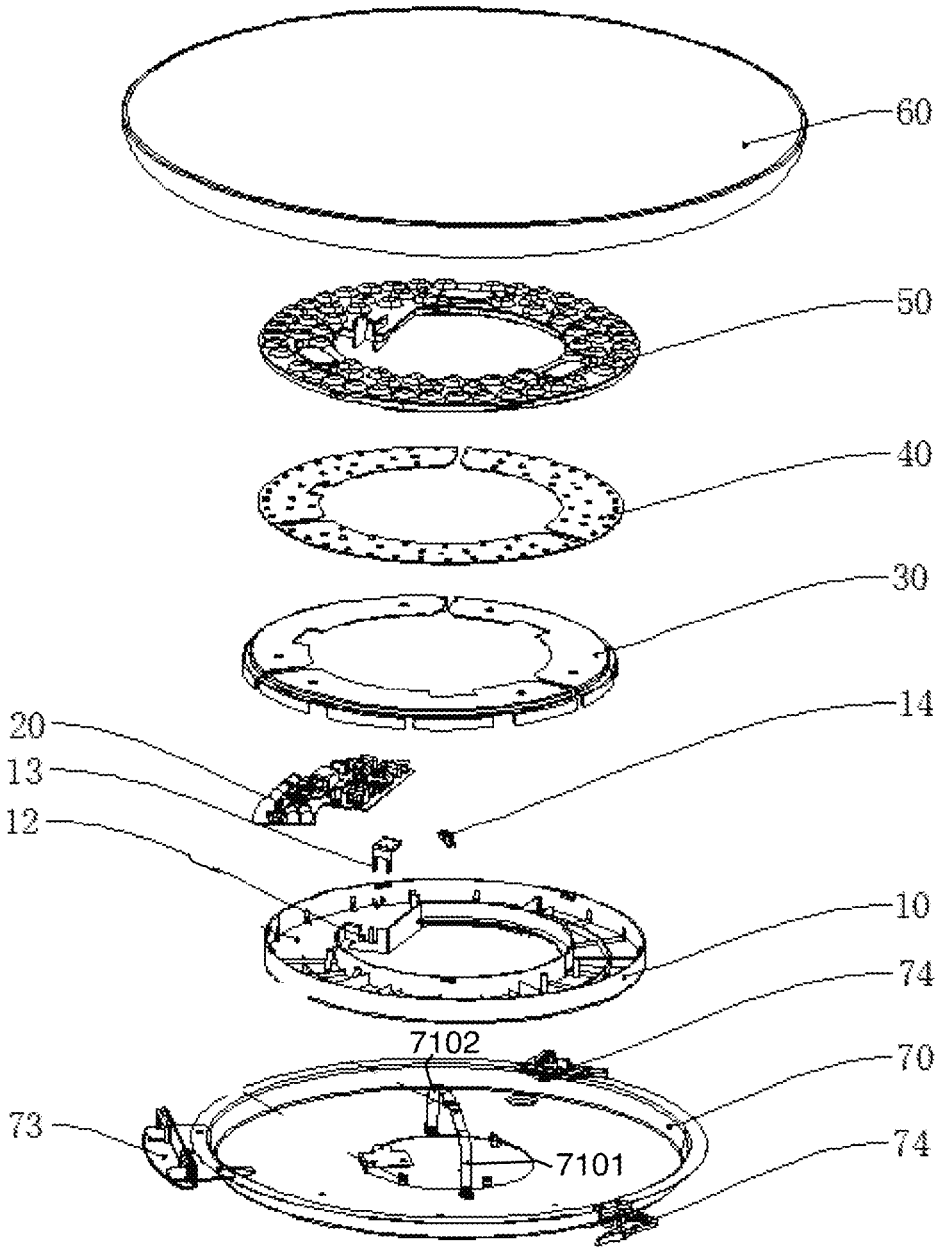
FIG. 1 illustrates an exploded view of a lighting apparatus embodiment.

In FIG. 1 and FIG. 3, two arms 7101, 7102 of the U-shape support bracket engage the inner wall of the bottom cover as shown in FIG. 3.

In FIG. 6, a battery 6626 is detachably disposed in a container space 6627 between the bottom cover 662 and the light source module 663.

Figure 9:
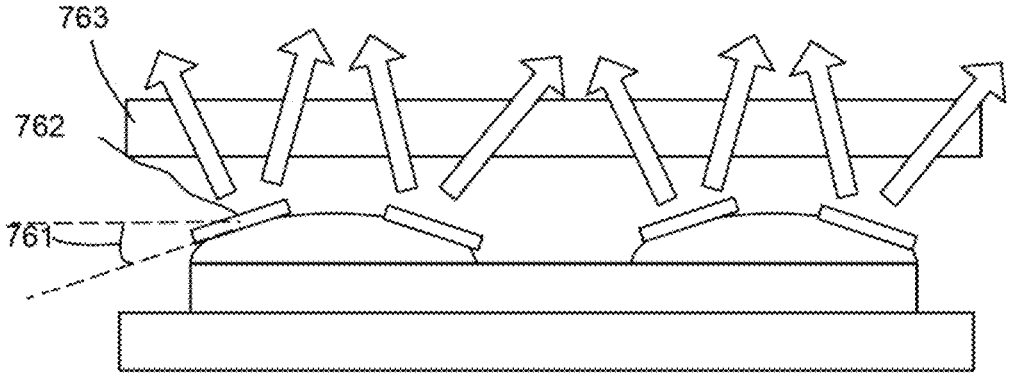
FIG. 9 shows an example on disposing the LED modules.

In FIG. 9, there are tilt angles 761 for placing the LED modules 762 respect to the light passing cover 763 for directing lights of the LED modules evenly on the light passing cover 763. The tilt angles 761 are arranged by reference to a distance between the LED modules 762 and the light passing cover 763 to distribute the light evenly on light escape plane.

Figure 10:
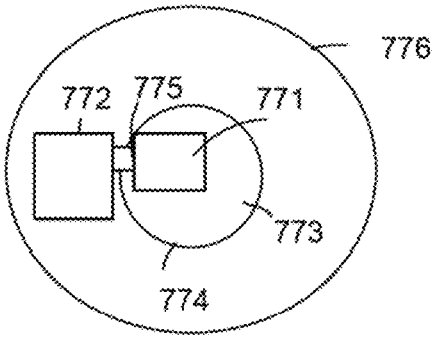
FIG. 10 shows another embodiment by adding a function module.

In FIG. 10, a smart control module 771 is electrically connected to the driver 772 and is placed in the main central opening 773.

In some embodiments, the smart control module 771 is detachable connected to an extending terminal 775 disposed on an inner wall 774 of the bottom cover 776.

In FIG. 1, a lighting apparatus has a light passing cover 60, a lens module 50, a light source module 40, a heat dissipation plate 30, a driver 20 and a bottom cover 10.

The bottom cover 10 is attached to the lens module 50 to enclose the light source module 30, and the heat dissipation plate 30 to form a portable module. The portable module refers to a module that is convenient to move and carry during assembling process. For example, there is a buckle structure for fixing the lens module 50 to the bottom cover 10, the light source module 40, the heat dissipation plate 30 and the driver 20 are stored in a container space 11 between the lens module 50 and the bottom cover 10.

There is an escape 12 for inserting wires or electronic terminal to contact the driver 20. There is an insulation block 13 for isolating and protecting the components of the driver 20 and the light source module 40.

The base plate 70 is used for being installed to a ceiling or other platform. There are a fixing plate 73 and two rotation buckles 74 for fixing the light passing cover 60. There is a U-shape support bracket 71 disposed on the base plate 70.

Please refer to FIG. 2. FIG. 2 illustrates another view of the base plate 70, the rotation buckles 74 and the fixing plate 73 on the base plate 70. The rotation buckles 74 are used for fixing the light passing cover 60.

Please refer to FIG. 3. In FIG. 3, the fixing plate 73 and the two buckles 74 are illustrated for another view on the base plate 70. The bottom cover 10 is fixed to the lens module 50. There is an insulation block 13 for protections components behind the insulation block 13. In addition, there is a grounding plate 14 for connecting to a ground on the base plate 70.

Figure 4:
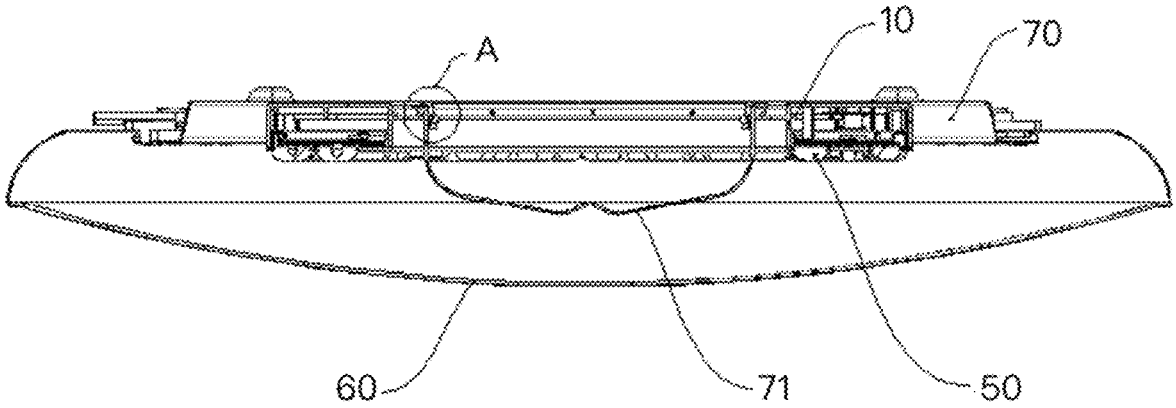
FIG. 4 illustrates a side view of the embodiment in FIG. 1.

Please refer to FIG. 4. In FIG. 4, another view of the example mentioned above is provided. The light passing cover 60 is detachable and the thus the driver and other components may be replaced to another parameters. The light passing cover 60 may be replaced, too. The side view of the example in FIG. 4 show the relation among the U-shape support bracket 71, the light passing cover 60, the bottom cover 10, the lens module 50 and the base plate 70.

Figure 5:
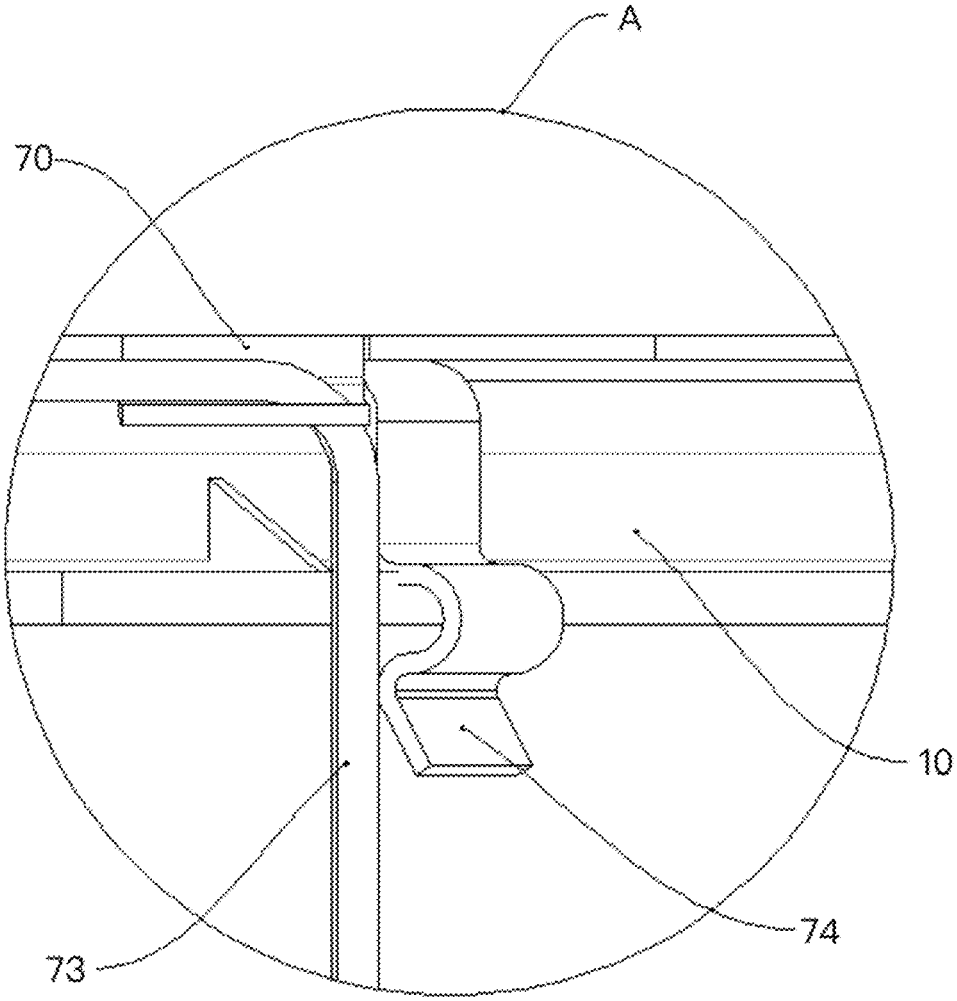
FIG. 5 illustrates a connection zoom-up view for component relation.

Please refer to FIG. 5, which is a zoom-up view of the section A in FIG. 4. The bottom cover 10 is fixing to the base plate 70. The rotation buckle 74 is used for fixing the light passing cover. The fixing plate 73 is used for fixing components.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a driver;

a bottom cover having a first central opening and a driver container for storing the driver;

a light source module having multiple LED modules and a second central opening;

a lens module having a third central opening and multiple diffusion lenses respectively placed above the multiple LED modules, wherein the lens module is fixed to the bottom cover to make the light source module, the driver, the lens module and the bottom cover as a portable module, the first central opening, the second central opening and the third central opening together form a main central opening;

a light passing cover; and a base plate for fixing to an installation platform, wherein the the bottom cover is fixed to the base plate, the base plate has multiple connectors for detachably connecting the light passing cover, wherein a smart control module is electrically connected to the driver and is placed in the main central opening.

2. The lighting apparatus of claim 1, further comprising a heat dissipation plate, wherein the heat dissipation plate is placed between the driver and the light source module, the heat dissipation plate has a fourth central opening, the fourth central opening corresponding to the main central opening.

3. The lighting apparatus of claim 1, wherein the lens module is a transparent plastic plate, the multiple diffusion lenses are formed directly on the transparent plastic plate.

4. The lighting apparatus of claim 1, wherein at least some of the LED modules have two types of LED chips.

5. The lighting apparatus of claim 1, wherein the light source module has multiple light source sectors.

6. The lighting apparatus of claim 1, wherein the driver has a first driver connector to attach to a second driver connector disposed on the bottom cover to fix driver to the bottom cover.

7. The lighting apparatus of claim 1, wherein the multiple connectors comprises a buckle plate and two rotation buckle pins.

8. The lighting apparatus of claim 1, wherein the bottom cover has an inner wall defining the first central opening, the base plate has at least a central protruding unit for aligning the inner wall of the bottom cover.

9. The lighting apparatus of claim 1, wherein a battery is detachably disposed in a container space between the bottom cover and the light source module.

10. The lighting apparatus of claim 1, wherein there are tilt angles for placing the LED modules respect to the light passing cover for directing lights of the LED modules evenly on the light passing cover.

11. The lighting apparatus of claim 1, wherein the smart control module is detachable connected to a extending terminal disposed on an inner wall of the bottom cover.

12. The lighting apparatus of claim 3, wherein the lens module has a buckle structure to fix to the bottom cover for concealing the driver and the light source module.

13. The lighting apparatus of claim 5, wherein the multiple light sources have buckle units for connecting the multiple light source sectors.

14. The lighting apparatus of claim 6, wherein the bottom cover has a conductive path for electrically connecting the driver to the light source module.

15. The lighting apparatus of claim 8, wherein there are multiple central protruding units, each central protruding unit has an elastic hook for deforming when inserting the bottom cover to the base plate and for holding the bottom cover to the base plate with elastic force of the multiple central protruding units.

16. The lighting apparatus of claim 8, wherein there is a U-shape support bracket disposed on the base plate, two arms of the U-shape support bracket engages the inner wall of the bottom cover.

17. The lighting apparatus of claim 13, wherein there is a heat dissipation plate disposed below the multiple light source sectors.

18. The lighting apparatus of claim 14, wherein the conductive path has a terminal for electrically connected to an external power wire for receiving an external power provided to the driver.

19. The lighting apparatus of claim 17, wherein the multiple light source sectors are buckled to electrical plugs on the heat dissipation plate to be electrically connected to the drive module.

* * * * *